US011252793B2

(12) United States Patent
Spagnoli

(10) Patent No.: US 11,252,793 B2
(45) **Date of Patent: *Feb. 15, 2022**

(54) MULTIPLE CAVITY MICROWAVE OVEN DOOR

(71) Applicant: WHIRLPOOL CORPORATION, Benton Harbor, MI (US)

(72) Inventor: Luana Spagnoli, Cassinetta (IT)

(73) Assignee: Whirlpool Corporation, Benton Harbor, MI (US)

( * ) Notice: Subject to any disclaimer, the term of this patent is extended or adjusted under 35 U.S.C. 154(b) by 154 days.

This patent is subject to a terminal disclaimer.

(21) Appl. No.: 16/599,418

(22) Filed: Oct. 11, 2019

(65) Prior Publication Data

US 2020/0045784 A1 Feb. 6, 2020

Related U.S. Application Data

(63) Continuation of application No. 15/107,579, filed as application No. PCT/US2013/077427 on Dec. 23, 2013, now Pat. No. 10,477,630.

(51) Int. Cl.

| | |
|---|---|
| ***H05B 6/76*** | (2006.01) |
| ***H05B 6/68*** | (2006.01) |
| ***H05B 6/80*** | (2006.01) |
| ***H05B 6/64*** | (2006.01) |
| ***H05B 6/66*** | (2006.01) |
| *H05B 6/46* | (2006.01) |

(52) U.S. Cl.

CPC ..... *H05B 6/68* (2013.01); *H05B 6/6402* (2013.01); *H05B 6/664* (2013.01); *H05B 6/763* (2013.01); *H05B 6/766* (2013.01); *H05B 6/80* (2013.01)

(58) Field of Classification Search

CPC .... H05B 6/6402; H05B 6/6408; H05B 6/642; H05B 6/6426; H05B 6/6432; H05B 6/6435; H05B 6/647; H05B 6/6482; H05B 6/664; H05B 6/68; H05B 6/686; H05B 6/70; H05B 6/705; H05B 6/707; H05B 6/72; H05B 6/725; H05B 6/763; H05B 6/766; H05B 6/80; H05B 6/804

USPC ..... 219/678, 736, 737, 738, 739, 740, 741, 219/742, 743, 752, 753, 756, 762, 763

See application file for complete search history.

(56) References Cited

U.S. PATENT DOCUMENTS 4,081,647 A * 3/1978 Torrey ..... H05B 6/763 219/741
4,329,557 A * 5/1982 Staats ..... H05B 6/6402 219/745

(Continued)

FOREIGN PATENT DOCUMENTS

BE 867122 A1 9/1978
GB 2002210 A 7/1978

(Continued)

*Primary Examiner* — Hung D Nguyen
(74) *Attorney, Agent, or Firm* — Price Heneveld LLP

(57) ABSTRACT

A microwave oven is provided herein having a cooking cavity, a dividing shelf for dividing the cooking cavity into at least two sub-cavities, and a door movable between an open and closed position for selectively providing and preventing access to the sub-cavities respectively. The door is provided with a choke frame configured to communicate with the dividing shelf in the closed position so as to attenuate microwave transmission between the sub-cavities.

17 Claims, 6 Drawing Sheets

(56) References Cited

U.S. PATENT DOCUMENTS

| | | | | |
|---|---|---|---|---|
| 4,511,779 | A * | 4/1985 | Bucksbaum | H05B 6/6402 219/732 |
| 4,780,597 | A * | 10/1988 | Linhart | F24C 15/166 219/396 |
| 5,111,028 | A * | 5/1992 | Lee | F24C 7/08 219/413 |
| 5,796,082 | A * | 8/1998 | Kim | H05B 6/6411 219/752 |
| 7,071,448 | B1 * | 7/2006 | Kim | F24C 15/16 219/394 |
| 7,129,447 | B1 | 10/2006 | Kim et al. | |
| 7,183,520 | B2 | 2/2007 | Park | |
| 2002/0060215 | A1 | 5/2002 | Allera et al. | |
| 2008/0148961 | A1 | 6/2008 | Hwang et al. | |
| 2010/0176123 | A1 | 7/2010 | Mihara et al. | |
| 2010/0276417 | A1 * | 11/2010 | Uchiyama | H05B 6/6402 219/719 |
| 2013/0153570 | A1 | 6/2013 | Carlsson et al. | |
| 2013/0168384 | A1 * | 7/2013 | Cadima | H01F 38/14 219/647 |

FOREIGN PATENT DOCUMENTS

| | | | |
|---|---|---|---|
| RU | 2127649 | C1 | 3/1999 |
| WO | 2009011111 | A1 | 1/2009 |

* cited by examiner

MULTIPLE CAVITY MICROWAVE OVEN DOOR

CROSS-REFERENCE TO RELATED APPLICATION

This application is a continuation of U.S. patent application Ser. No. 15/107,579 filed Jun. 23, 2016, entitled MULTIPLE CAVITY MICROWAVE OVEN DOOR, now U.S. Pat. No. 10,477,630, which claims priority under 35 U.S.C. § 371 to International Application No. PCT/US2013/077427, filed Dec. 23, 2013.

FIELD OF THE INVENTION

The invention relates generally to a microwave oven having multiple cooking cavities, and more specifically to the door of a microwave oven having multiple cooking cavities.

BACKGROUND

Traditional microwave ovens usually comprise a single cooking cavity in which a foodstuff to be cooked is placed. The number of foodstuffs that can be prepared at the same time in such traditional microwave ovens is therefore limited and inadequate for many users. For example, preparing different foodstuffs that require different cooking parameters in a single cavity microwave oven may require the time to cook them sequentially rather than concurrently because of the different cooking parameters. Out of this need, microwave ovens with multiple cooking cavities were developed.

For example, U.S. Pat. No. 10,129,936 filed Nov. 13, 2018, discloses a microwave oven with two sub-cavities to simultaneously cook multiple foodstuffs with improved cooking evenness and cooking time. Each sub-cavity is provided with a microwave generator and feeding port to independently cook foodstuffs located therein. A removable dividing shelf between the sub-cavities attenuates microwave transmission between the sub-cavities. A sealing choke where the shelf meets the walls of the cavity aids the attenuation. However, transmission may still occur between the shelf and the door.

SUMMARY

In one aspect, the invention relates to a microwave oven that has a cooking cavity, a dividing shelf for dividing the cooking cavity into at least two sub-cavities and a door movable between an open and closed position for selectively providing and preventing access to the sub-cavities respectively. The door may be provided with a choke frame configured to communicate with the dividing shelf in the closed position so as to attenuate microwave transmission between sub-cavities.

DETAILED DESCRIPTION

Figure 1:
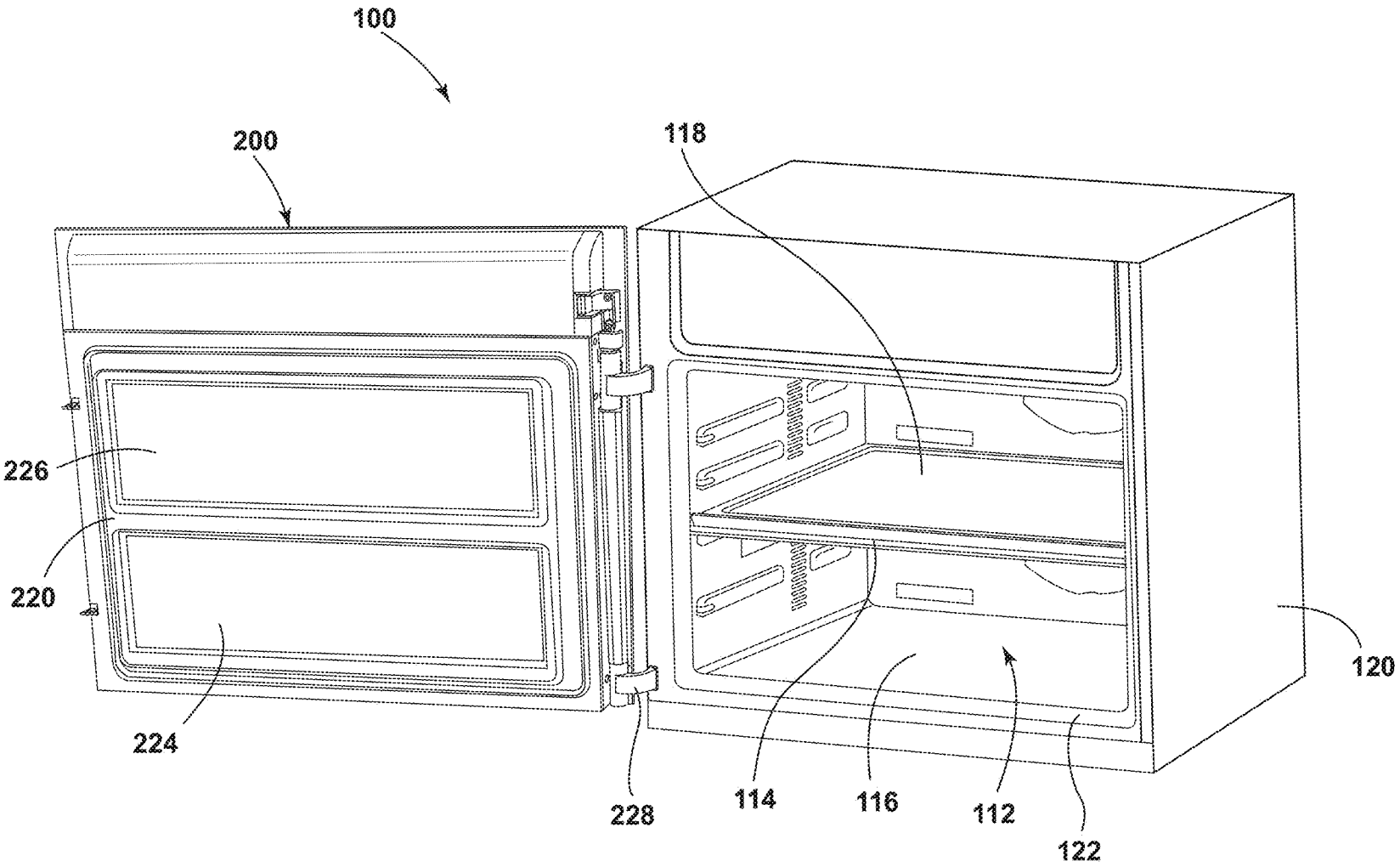
FIG. 1 is a perspective view of a microwave oven according to an embodiment of the invention.

Turning now to the drawings and to FIG. 1 in particular, there is shown a perspective view of a microwave oven 100 according to an embodiment of the invention. The microwave oven 100 includes a cabinet 120 defining a cooking cavity 112 and a dividing shelf 114 which divides the cooking cavity 112 into a first sub-cavity 116 and a second sub-cavity 118. The microwave oven 100 further includes a door 200. The door 200 is provided with a choke frame 220 which encompasses a first pane of glass 224 and a second pane of glass 226 which correspond, respectively, to the first and second sub-cavities 116, 118. The first and second panes of glass 224, 226 are constructed in such a way that they are optically transparent but not transparent to microwaves. Furthermore, the first and second panes of glass 224, 226 are separated by the choke frame 220. A hinge 228 mounted to one side of the door 200 and to the cabinet 120 pivotally connects the door 200 to the cabinet 120.

Figure 5:
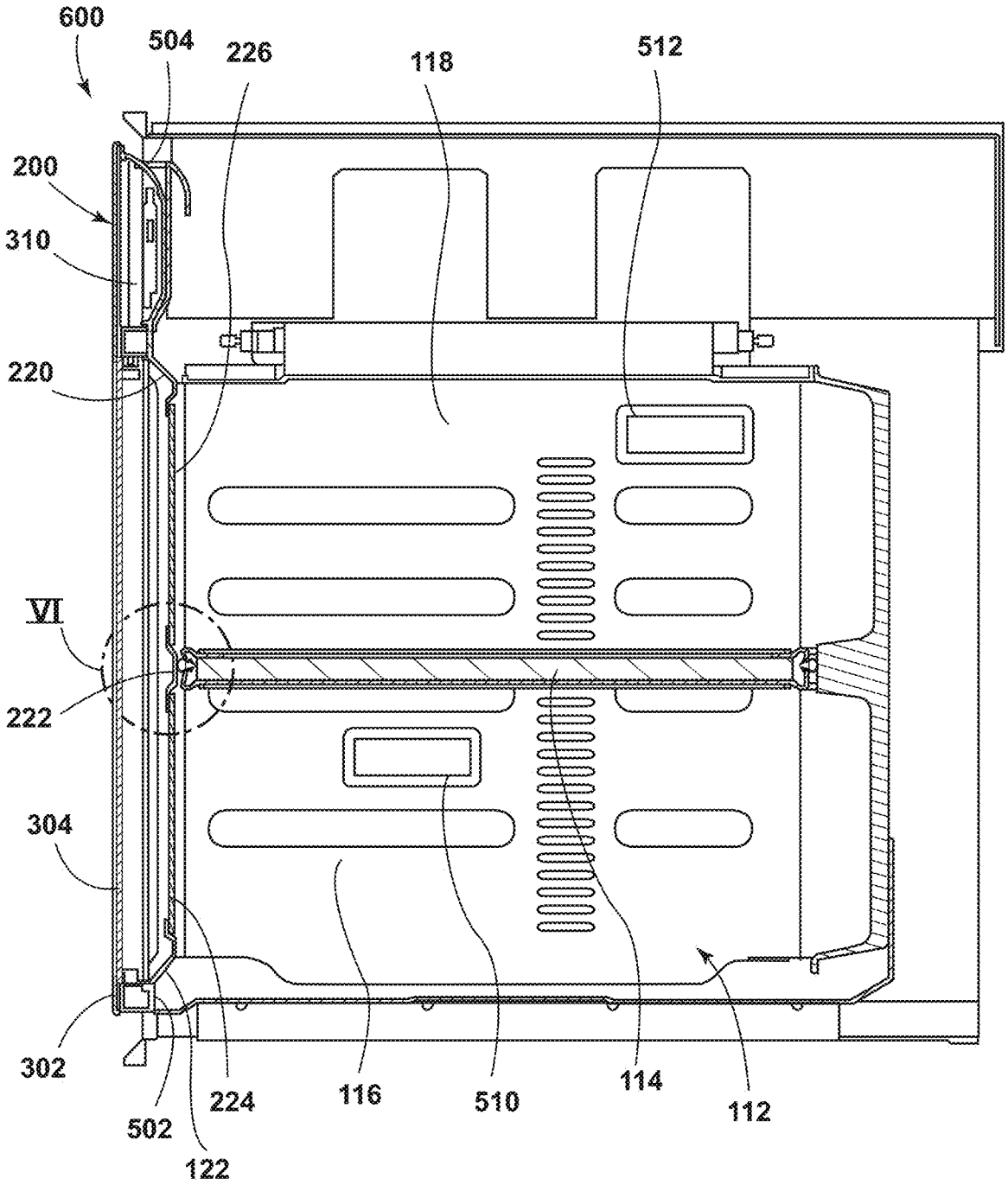
FIG. 5 is a cross-sectional view of a microwave oven according to an embodiment of the invention.

The hinge 228 allows the door 200 to pivotally move between a first open position, best seen in FIG. 1, for simultaneous access to the first and second sub-cavities 116, 118 and a second closed position, best seen in FIG. 5, for preventing simultaneous access to the first and second sub-cavities 116, 118. When the door 200 is in the second position, the choke frame 220, and particularly the area of the choke frame 220 between the first and second panes of glass 224, 226, is in communication with the dividing shelf 114 in such a manner so as to attenuate microwave transmission between the first and second sub-cavities 116, 118. Furthermore, the choke frame 220 is also in communication with a cooking cavity aperture perimeter 122 in such a manner so as to attenuate microwave transmission between the cooking cavity 112 and the door 200.

According to one embodiment, the dividing shelf 114 may be arranged at half of the height of the cooking cavity 112, thereby enabling the division of the cooking cavity 112 into the two sub-cavities 116, 118 essentially identical in size (or volume). However, according to another embodiment, the dividing shelf 114 may be arranged such that the cooking cavity 112 may be divided in different manners (e.g. at one-third or two-thirds of the height or, in other cases, at one-fourth or three-fourths of the height), thereby resulting in sub-cavities 116, 118 of different sizes/volumes. In yet another embodiment, the microwave oven 100 may not be equipped with a dividing shelf 114 such that the cooking cavity 112 is undivided and that the choke frame 120 only prevents leakage of microwaves between the cooking cavity 112 and the door 200.

Figure 2:
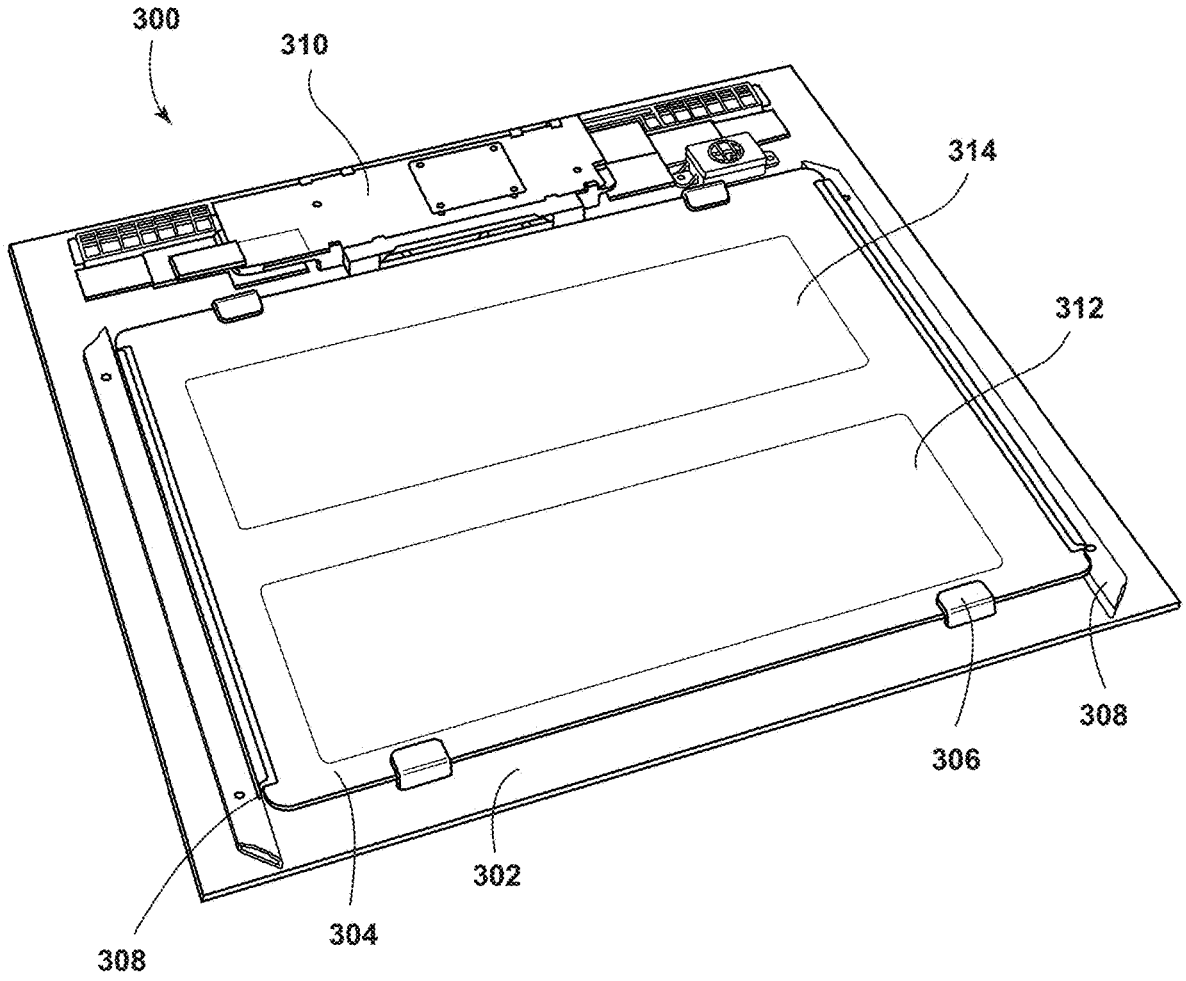
FIG. 2 is a perspective view of a microwave oven door aesthetic assembly according to an embodiment of the invention.

FIG. 2 shows a perspective view of a microwave oven door aesthetic assembly 300 according to an embodiment of the invention. The aesthetic assembly 300 includes an external panel 302. The external panel 302 may be made from any material suitable for the application as described herein including, but not limited to: glass, plastic, metal, ceramic or a composite. The external panel 302 may have first and second apertures 312, 314 that correspond, respectively, to the first and second panes of glass 224, 226 shown in FIG.

1. A second glass panel 304 is mounted to two lateral rails 308 which are secured to the external panel 302. Retainers 306 mounted to the external panel 302 may also aid in securing the second glass panel 304 so as to prevent movement of the second glass panel 304. The second glass panel 304 is constructed in such a way that it is optically transparent but not transparent to microwaves. A user interface (UI) 310 may also be mounted to the external panel 302 where a third aperture, not shown, formed in the external panel 302 may correspond to a display, not shown, of the UI 310. The UI 310 may function to operate the microwave oven 100 and to display a plurality of information.

Figure 3:
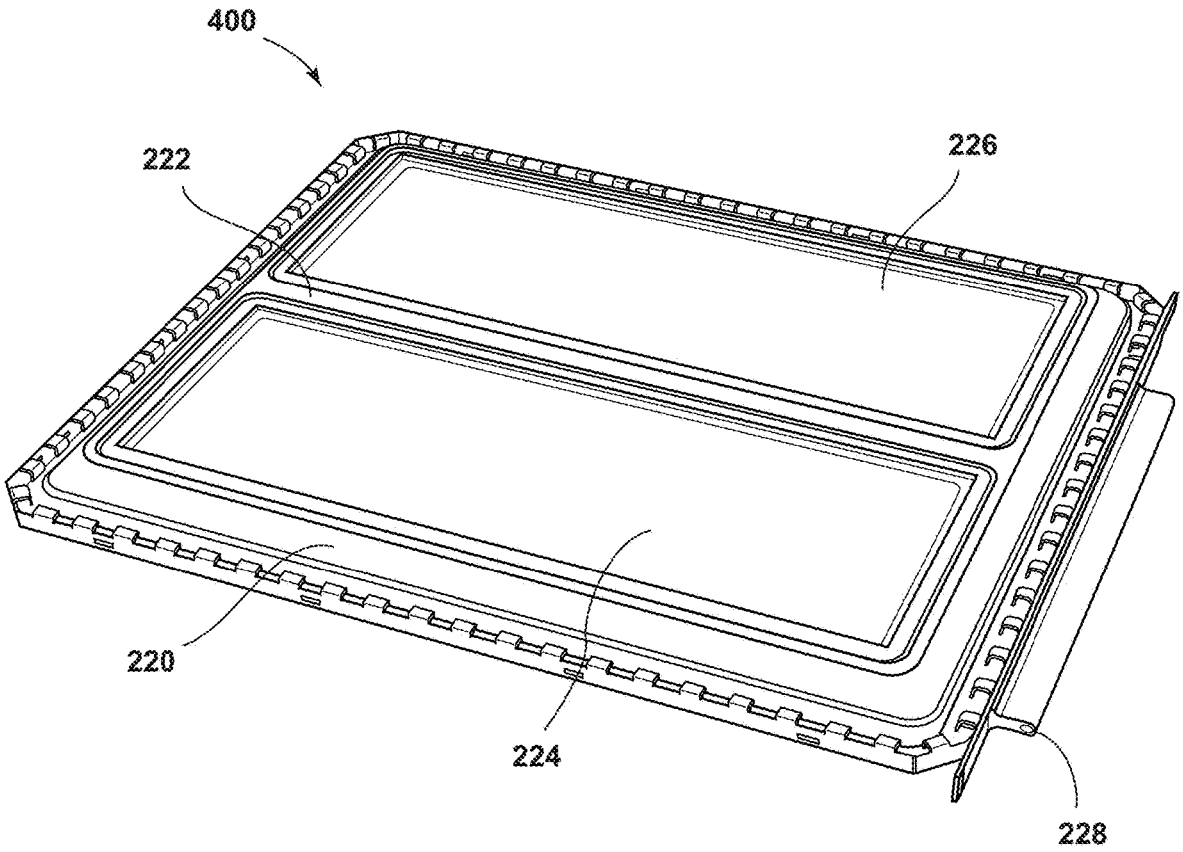
FIG. 3 is a perspective view of a microwave oven door structural assembly according to an embodiment of the invention.

FIG. 3 shows a perspective view of a microwave oven door structural assembly 400 according to an embodiment of the invention. The structural assembly 400 includes the choke frame 220, the first pane of glass 224, the second pane of glass 226, and the hinge 228. The choke frame 220 may also include a metal reed 222 positioned between the first and second panes of glass 224, 226 so as to communicate with the dividing shelf 114 shown in FIG. 1 and provide electrical continuity with the dividing shelf 114 when the door 200 is in the second (closed) position. The metal reed 222 may be formed integrally with the choke frame 220 or securely mounted to the choke frame 220. It is preferred that the width of the metal reed 222 be minimized in order to maximize the size of the first and second panes of glass 224, 226 while ensuring sufficient communication between the metal reed 222 and the dividing shelf 114 to attenuate microwave transmission between the first and second sub-cavities 116, 118 also shown in FIG. 1.

Figure 4:
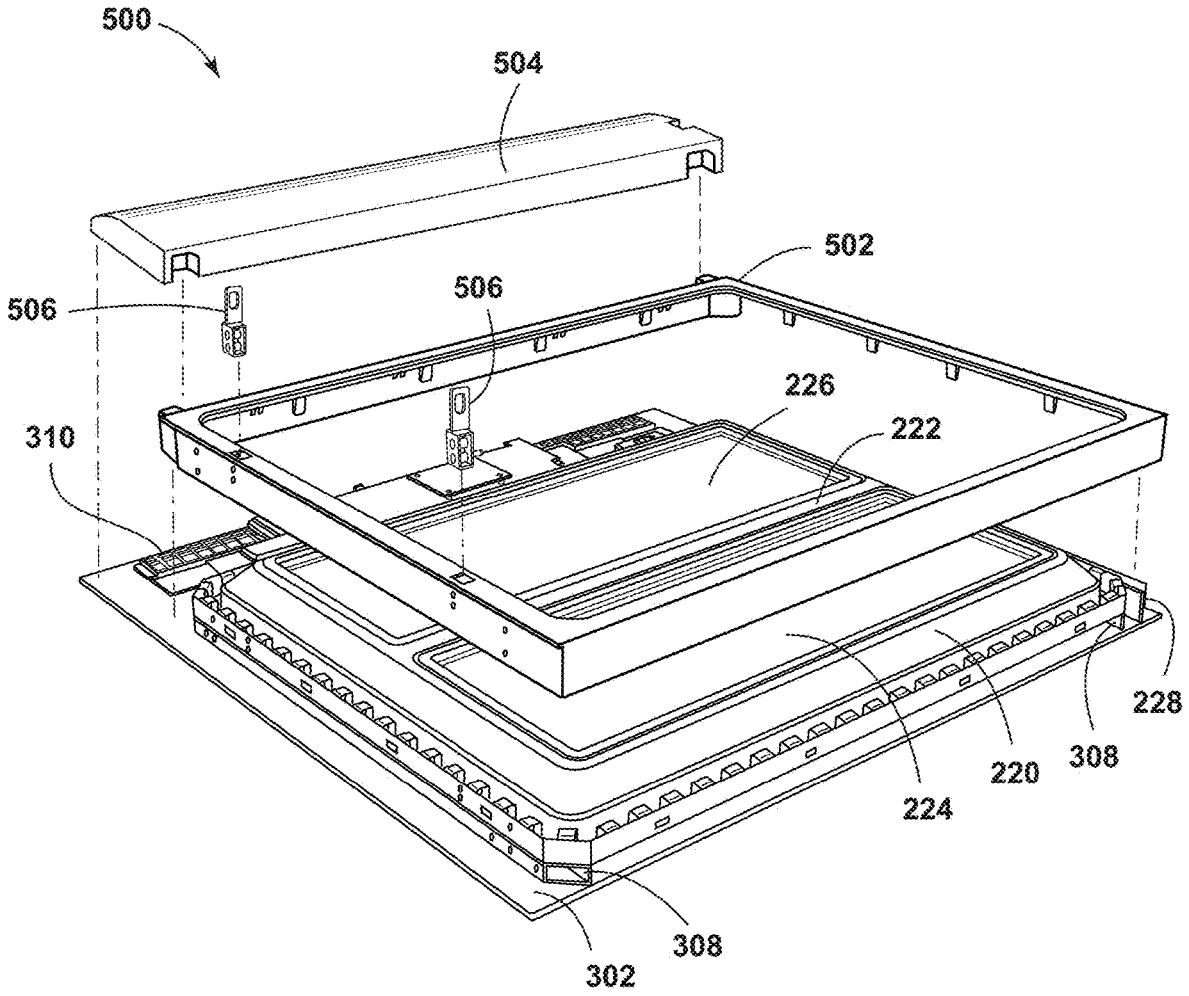
FIG. 4 is an exploded view of partially assembled microwave oven door according to an embodiment of the invention.

FIG. 4 shows an exploded view of a partially assembled microwave oven door 500 according to an embodiment of the invention. The partially assembled microwave oven door 500 shows the structural assembly 400 mounted to the aesthetic assembly 300 where the choke frame 220 is seated on the lateral rails 308 and a choke frame cover 502 encompasses the choke frame 220 and secures it to the lateral rails 308. At least one and preferably two pins 506 may be secured to the choke frame cover 502. The pins 506 may be received by apertures, not shown, in the cabinet 120 of FIG. 1 in order to secure the door 200 to the cabinet 120 when the door 200 is in the second position. A UI cover 504 may be positioned over the UI 310 and secured to the external panel 302 to protect the UI 310 and provide an aesthetic appearance.

Figure 6:
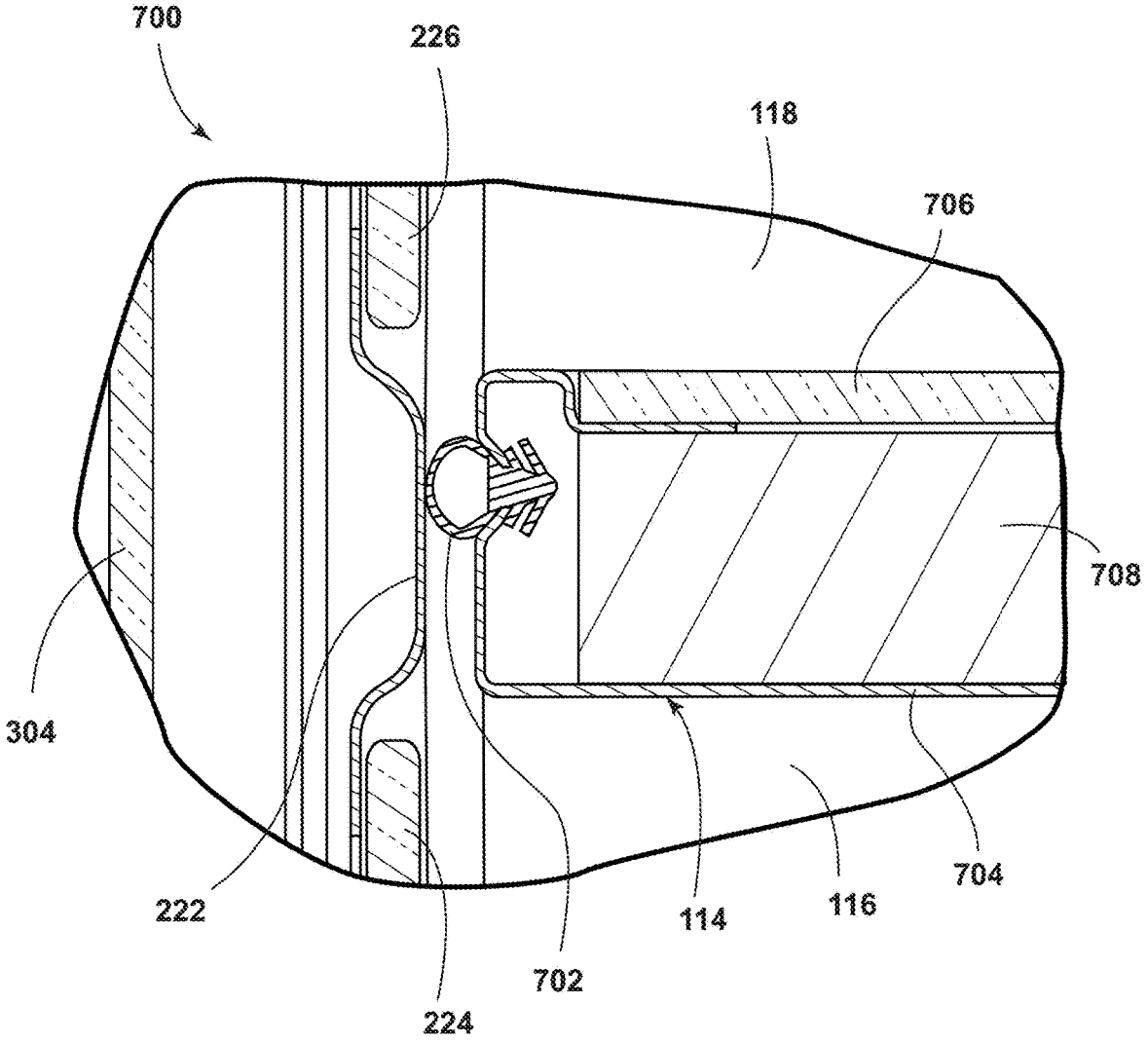
FIG. 6 is a cross-sectional view of section VI of FIG. 5 showing the metal reed and dividing shelf interface according to an embodiment of the invention.

The structural assembly 400 is mounted to the aesthetic assembly 300 in such a way that the second glass panel 304 shown in FIG. 2 is spaced apart from the first and second panes of glass 224, 226, best shown in FIG. 6, so as to provide a layer of thermal insulation between the panes of glass 224, 226 and the second glass panel 304. Furthermore, the first and second apertures 312, 314 in the external panel 302 substantially align with the first and second glass panels 224, 226 so as to provide visibility into the sub-cavities 116, 118 shown in FIG. 1.

FIG. 5 shows a cross-sectional view of a microwave oven 600 according to an embodiment of the invention with the door 200 in the second (closed) position. The choke frame 220 forms a seal with the cooking cavity aperture perimeter 122 to attenuate the transmission of microwaves between the cooking cavity 112 and door 200. The metal reed 222 forms a seal with dividing shelf 114 to attenuate the transmission of microwaves between the first and second sub-cavities 116, 118. The first and second panes of glass 224, 226 and the second glass panel 304 also attenuate transmission of microwaves from the cooking cavity 112 or the first or second sub-cavities 116, 118. The dividing shelf 114 is also constructed in such a way that it attenuates the transmission of microwaves between the first and second sub-cavities 116, 118.

Microwave energy may be selectively introduced to the first and second sub-cavities 114, 116 through at least a first and second wave guide 510, 512 corresponding, respectively, to the first and second sub-cavities 116, 118. Each wave guide 510, 512 may be supplied microwaves from a separate microwave generator including, but not limited to, a magnetron or a solid state radio frequency (RF) device to independently cook foodstuffs located in the two sub-cavities 116, 118.

In a preferred embodiment, the transmitted microwave bandwidth of each of the wave guides 510, 512 may include frequencies ranging from 2.4 GHz to 2.5 GHz. The wave guides 510, 512 may be configured to transmit other microwave frequency bands. For example, the bandwidth of frequencies between 2.4 GHz and 2.5 GHz is one of several bands that make up the industrial, scientific and medical (ISM) radio bands. In another embodiment, the transmission of other microwave frequency bands is contemplated and may include non-limiting examples contained in the ISM bands defined by the frequencies: 13.553 MHz to 13.567 MHz, 26.957 MHz to 27.283 MHz, 902 MHz to 928 MHz, 5.725 GHz to 5.875 GHz and 24 GHz to 24.250 GHz.

Now referring to FIG. 6, there is shown a closer cross-sectional view 700 showing the metal reed 222 and dividing shelf 114 interface according to an embodiment of the invention. The dividing shelf 114 may be provided with a gasket 702 configured to communicate with the metal reed 222 wherein the metal reed 222 is positioned to provide electrical continuity with the gasket 702 disposed on the dividing shelf 114 when the door 200 is in the second position in order to attenuate the transmission of microwaves between the first and second sub-cavities 116, 118. The gasket 702 may be made from any suitable gasket material having electrical conductivity in the range of 0.1 $\Omega/cm^2$ to 10 $\Omega/cm^2$. The gasket 702 may also be disposed around all four sides of the dividing shelf 114 so as to communicate with the walls of the cooking cavity 112, shown in FIG. 1, to provide electrical continuity and to attenuate the transmission of microwaves between the first and second sub-cavities 116, 118.

The dividing shelf 114 may have a structural layer 704 that is not transparent to microwaves, an intermediate thermal insulation layer 708 and an upper dielectric layer 706. The structural layer 704 may essentially form a rectangular box with an aperture in the top side of the box. One example of a suitable structural layer 704 of a dividing shelf 114 is disclosed in U.S. Pat. No. 10,129,936 issued Nov. 13, 2018, which is incorporated herein by reference in its entirety. The dielectric layer 706 may be disposed over the aperture and be supported by the structural layer 704 and may be suitable for cooking a foodstuff placed directly on the dielectric layer 706. By spacing the dielectric layer 706 a suitable distance away from the lower portion of the structural layer 704 which is not transparent to microwaves, efficient microwave cooking of foodstuff placed directly on the dielectric layer 706 may be achieved. The thermal insulation layer 708 may either partially or entirely fill the area between the structural layer 704 and the dielectric layer 706 with a suitable thermally insulating material to provide a layer of thermal insulation between the first and second sub-cavities 116, 118. Furthermore, the space between the second glass panel 304 and the metal reed 222 and first and second panes of glass 224, 226 provides a layer of thermal insulation between the first and second sub-cavities 116, 118 and the external panel 302.

In accordance with one embodiment, at least the metal reed 222, choke frame 220, second glass panel 304, first and second panes of glass 224, 226, gasket 702, and structural layer 706 of the dividing shelf 114 may be optimized in at least one of both materials and configuration to attenuate transmission of microwave frequencies ranging from 2.4 GHz to 2.5 GHz. The dielectric layer 706 and thermal insulation layer 708 may be optimized in at least one of both materials and configuration to promote the transmission of microwave frequencies ranging from 2.4 GHz to 2.5 GHz.

It is contemplated that the present disclosure encompasses at least the following inventive concepts:

Oven Door Structure

1. A microwave oven comprising a cooking cavity, a dividing shelf for dividing the cooking cavity into first and second sub-cavities, and a door movable between a first position for simultaneous access to the first and second sub-cavities and a second position for preventing simultaneous access to the first and second sub-cavities, characterized by:

a choke frame on the door, wherein the choke frame is in communication with the dividing shelf when the door is in the second position to attenuate microwave transmission between the first and second sub-cavities.

2. The microwave oven of 1, wherein the choke frame includes a conductive reed positioned to provide electrical continuity with the dividing shelf when the door is in the second position.

3. The microwave oven of 1 or 2, further comprising at least two panes of glass disposed in the door corresponding, respectively, to the first and second sub-cavities.

4. The microwave oven of 3, wherein the choke frame encompasses the at least two panes of glass.

5. The microwave oven of any one of 3-4, wherein the door further includes a glass panel mounted to lateral rails and spaced from the at least two panes of glass for thermal insulation.

6. The microwave oven of 5, further comprising a cover to secure the choke frame to the lateral rails.

7. The microwave oven of any one of 1-6, further comprising a user interface on the door.

8. The microwave oven of any one of 1-7, wherein the dividing shelf has a gasket on at least one side thereof to communicate with the choke frame.

9. The microwave oven of 8, wherein the dividing shelf has a gasket on all sides thereof so as to communicate with the walls of the cooking cavity to provide electrical continuity and to attenuate the transmission of microwaves between the sub-cavities.

10. The microwave oven of any one of 1-8, wherein the dividing shelf has thermal insulation material between a top and bottom surface thereof.

Dividing Shelf for a Microwave Oven

1. A microwave oven comprising a cooking cavity, and a dividing shelf for dividing the cooking cavity into first and second sub-cavities characterized by:

the dividing shelf having a gasket disposed around all sides thereof to attenuate the transmission of microwaves between the sub-cavities, an upper dielectric layer, and a lower structural layer that is not transparent to microwaves and spaced from the upper dielectric layer with thermal insulation material between the upper dielectric layer and lower structural layer.

2. The microwave oven of 1, wherein the upper dielectric layer includes glass.

3. The microwave oven of 1 or 2, wherein the lower structural layer is metal.

4. The microwave oven of any of 1-3, wherein the lower structural layer forms a rectangular box with an aperture in a top side of the box.

5. The microwave oven of 4, wherein the upper dielectric layer is disposed over the aperture.

6. The microwave oven of any of 1-5, wherein the gasket or the lower structural layer is optimized in at least one of material or configuration to attenuate transmission of microwave frequencies ranging from 2.4 GHz to 2.5 GHz.

7. The microwave oven of any of 1-6, wherein the upper dielectric layer or the thermal insulation material is optimized in at least one of material or configuration to promote transmission of microwave frequencies ranging from 2.4 GHz to 2.5 GHz.

The embodiments described above provide for a variety of benefits including the attenuation of microwave transmission between multiple cavities in a microwave oven such that foodstuffs contained in different cooking cavities may be cooked at the same time and independently of each other resulting in more even cooking and reduced cooking time.

While the invention has been specifically described in connection with certain specific embodiments thereof, it is to be understood that this is by way of illustration and not of limitation, and the scope of the appended claims should be construed as broadly as the prior art will permit.

The invention claimed is:

1. A microwave oven comprising:

a cooking cavity;

a dividing shelf for dividing the cooking cavity into first and second sub-cavities, wherein the dividing shelf comprises:

a gasket disposed around all sides thereof to attenuate the transmission of microwaves between the sub-cavities, an upper dielectric layer, a lower structural layer that is not transparent to microwaves and spaced from the upper dielectric layer; and thermal insulation material filling the space between the upper dielectric layer and lower structural layer, the thermal insulation material comprising a solid thermal insulation material;

a door movable between a first position for simultaneous access to the first and second sub-cavities and a second position for preventing simultaneous access to the first and second sub-cavities; and a choke frame on the door, wherein the choke frame is in communication with the dividing shelf when the door is in the second position to attenuate microwave transmission between the first and second sub-cavities.

2. The microwave oven of claim 1, wherein the upper dielectric layer includes glass.

3. The microwave oven of claim 1, wherein the lower structural layer is metal.

4. The microwave oven of claim 1, wherein the lower structural layer forms a rectangular box with an aperture in a top side of the box.

5. The microwave oven of claim 4, wherein the upper dielectric layer is disposed over the aperture.

6. The microwave oven of claim 1, wherein the gasket or the lower structural layer is optimized in at least one of material or configuration to attenuate transmission of microwave frequencies ranging from 2.4 GHz to 2.5 GHz.

7. The microwave oven of claim 1, wherein the choke frame extends the width of the door adjacent the divider shelf.

8. A microwave oven comprising:

a cooking cavity; and a dividing shelf for dividing the cooking cavity into first and second sub-cavities, wherein the dividing shelf comprises:

a gasket disposed around all sides thereof to attenuate the transmission of microwaves between the sub-cavities, an upper dielectric layer, a lower structural layer that is not transparent to microwaves and spaced from the upper dielectric layer; and thermal insulation material filling the space between the upper dielectric layer and lower structural layer, the thermal insulation material comprising a solid thermal insulation material, wherein the thermal insulation material is optimized in at least one of material or configuration to promote transmission of microwave frequencies ranging from 2.4 GHz to 2.5 GHz.

9. A microwave oven comprising:

a cooking cavity;

a dividing shelf for dividing the cooking cavity into first and second sub-cavities, wherein the dividing shelf comprises:

a gasket disposed around all sides thereof to attenuate the transmission of microwaves between the sub-cavities, an upper dielectric layer including glass, a lower structural layer that is not transparent to microwaves and spaced from the upper dielectric layer; and thermal insulation material filling the space between the upper dielectric layer and lower structural layer;

a door movable between a first position for simultaneous access to the first and second sub-cavities and a second position for preventing simultaneous access to the first and second sub-cavities; and a choke frame on the door, wherein the choke frame is in communication with the dividing shelf when the door is in the second position to attenuate microwave transmission between the first and second sub-cavities.

10. The microwave oven of claim 9, wherein the lower structural layer is metal.

11. The microwave oven of claim 9, wherein the lower structural layer forms a rectangular box with an aperture in a top side of the box.

12. The microwave oven of claim 11, wherein the upper dielectric layer is disposed over the aperture.

13. The microwave oven of claim 9, wherein the gasket or the lower structural layer is optimized in at least one of material or configuration to attenuate transmission of microwave frequencies ranging from 2.4 GHz to 2.5 GHz.

14. The microwave oven of claim 9, wherein the upper dielectric layer or the thermal insulation material is optimized in at least one of material or configuration to promote transmission of microwave frequencies ranging from 2.4 GHz to 2.5 GHz.

15. The microwave oven of claim 9, wherein the choke frame extends the width of the door adjacent the divider shelf.

16. A microwave oven comprising:

a cooking cavity;

a dividing shelf for dividing the cooking cavity into first and second sub-cavities, wherein the dividing shelf comprises:

a gasket disposed around all sides thereof to attenuate the transmission of microwaves between the sub-cavities, an upper dielectric layer including glass, a lower structural layer that is not transparent to microwaves and spaced from the upper dielectric layer, wherein the lower structural layer is metal; and thermal insulation material filling the space between the upper dielectric layer and lower structural layer, wherein the lower structural layer forms a rectangular box with an aperture in a top side of the box, and wherein the upper dielectric layer is disposed over the aperture;

a door movable between a first position for simultaneous access to the first and second sub-cavities and a second position for preventing simultaneous access to the first and second sub-cavities; and a choke frame on the door, wherein the choke frame is in communication with the dividing shelf when the door is in the second position to attenuate microwave transmission between the first and second sub-cavities.

17. The microwave oven of claim 16, wherein the choke frame extends the width of the door adjacent the divider shelf.

* * * * *